US007628466B2

(12) United States Patent
Cellura et al.

(10) Patent No.: US 7,628,466 B2
(45) Date of Patent: Dec. 8, 2009

(54) METHOD FOR INCREASING PRINTHEAD RELIABILITY

(75) Inventors: Mark A. Cellura, Webster, NY (US); Elliott A. Eklund, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 370 days.

(21) Appl. No.: 11/820,612

(22) Filed: Jun. 20, 2007

(65) Prior Publication Data

US 2008/0316247 A1 Dec. 25, 2008

(51) Int. Cl.
*B41J 29/393* (2006.01)

(52) U.S. Cl. ..... 347/19; 347/22

(58) Field of Classification Search ..... 347/19, 347/22–23, 29–33
See application file for complete search history.

(56) References Cited

U.S. PATENT DOCUMENTS 6,270,201 B1 * 8/2001 Kasperchik et al. ..... 347/65
6,557,971 B1 5/2003 Vega et al.
6,698,862 B1 * 3/2004 Choi et al. ..... 347/17
6,739,693 B1 5/2004 Ferringer
7,093,930 B2 8/2006 Yildirim et al.
7,111,932 B2 9/2006 Steed et al.
7,322,664 B2 * 1/2008 Kakutani et al. ..... 347/15

* cited by examiner

*Primary Examiner*—Lamson D Nguyen
(74) *Attorney, Agent, or Firm*—Maginot, Moore & Beck

(57) ABSTRACT

A maintenance method for an ink jet imaging device comprises ejecting drops from a plurality of ink jets to successively form a plurality of images on the image receiver. Inter-image intervals between the ejection of drops to form one image in the plurality of images and the ejection of drops to form a successive image in the plurality of images are detected. A plurality of drops is ejected from at least a portion of the ink jets in the plurality of ink jets during at least one detected inter-image interval. The plurality of ejected drops having at least one drop ejecting characteristic selected from: a drop mass for the plurality of drops being greater than a standard drop mass; a drop ejecting frequency for the plurality of drops being lower than a standard drop ejecting frequency; and a substantially sequential drop ejecting pattern for the plurality of drops.

19 Claims, 4 Drawing Sheets

METHOD FOR INCREASING PRINTHEAD RELIABILITY

TECHNICAL FIELD

This disclosure relates generally to ink jet printers, and in particular, to a method of maintaining stable operations of the print head assembly used in ink jet printers.

BACKGROUND

Fluid ink jet systems typically include one or more printheads having a plurality of ink jets from which drops of fluid are ejected towards a recording medium. The ink jets of a printhead receive ink from an ink supply chamber, or manifold, in the printhead which, in turn, receives ink from a source, such as a melted ink reservoir or an ink cartridge. Each ink jet includes a channel having one end in fluid communication with the ink supply manifold. The other end of the ink channel has an orifice, or nozzle, for ejecting drops of ink. The nozzles of the ink jets may be formed in an aperture, or nozzle, plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to each other, the deposited drops can be precisely patterned to form particular text and graphic images on the recording medium.

One difficulty faced by fluid ink jet systems is contamination of the exterior and/or interior ink pathways of a printhead. The exterior ink pathways of a printhead include the nozzle plate, ink jet nozzles in the nozzle plate, and the portions of the ink jet channels leading to the nozzles. The exterior ink pathways of a printhead may accumulate fibers, dust, and the like, during the printing process. In addition, excess dried ink may accumulate on the nozzle plate or in the nozzles and exterior channels of the ink jets. The accumulation of ink or other contaminants on the nozzle plate may partially or completely block the nozzles in the nozzle plate and, therefore, interfere with the passage of ink drops out of the nozzles.

The interior ink pathways include the ink supply, supply manifolds, ink supply pathways from the reservoirs to the manifolds, and ink jet channel inlets from the supply manifold to the ink jets. Interior ink pathways may be contaminated by particles, such as debris or gas bubbles. For example, debris may become trapped in a printhead during manufacture or assembly of the printhead. Gas or air bubbles may form in the interior ink pathways as a byproduct of operation of a printhead, such as, for example, high frequency firing of the ink jets or high operating temperatures in the printhead. These internal contaminants that form or originate in the interior ink pathways may accumulate at the ink jet channel inlets or enter into the channels and partially or completely block ink flow into the channels.

Partially or completely blocked ink jet nozzles and/or channels can lead to ink jet malfunctions or failures resulting in missing, undersized or misdirected drops on the recording media that degrade the print quality. Maintenance procedures have been implemented in ink jet printers for preventing and/or clearing ink jet blockages. Examples of such previously known maintenance procedures include purging and wiping.

Purging procedures typically involve ejecting a plurality of drops from each ink jet in order to clear contaminants from the jets. The purged ink may be collected in a waste ink reservoir, such as, for example, a waste tray or spittoon. Alternatively, ink may be purged onto an image transfer surface, such as, for example, a belt or drum, and subsequently cleaned from the transfer surface. Wiping procedures are usually performed by a wiper blade that moves relative to the nozzle plate to remove ink residue, as well as any paper, dust or other debris that has collected on the nozzle plate. Purging and wiping procedures may each be performed alone or in conjunction with each other. For example, a wiping procedure may be performed after ink is purged through the jets in order to wipe excess ink from the nozzle plate.

The ejection of the drops during a purging procedure may be controlled so that a purging operation may be effective against a particular form of ink jet contamination. For example, a purging procedure for clearing external contaminants from ink jet nozzles typically involves ejecting a plurality of drops in succession from each ink jet of a printhead. Ejecting a plurality of drops in succession from an ink jet may dislodge, and subsequently eject, contaminants that have accumulated in or around the ink jet nozzles.

A known purging procedure for clearing internal contaminants from the ink jet channel inlets involves firing the ink jets in a specific pattern to "move" internal contaminants that have accumulated at the channel inlets to less harmful positions in the manifold. The movement of the internal contaminants is caused by back pressure pulses that result from ink jet firings. The back pressure pulses may dislodge contaminants that have formed at the channel inlets and force them back into the manifold. By sequentially firing the jets, the sequential back pulses may push contaminants along the direction that the jets are fired until they reach less harmful positions within the manifold such as, for example, positions in the manifold where no jets are located.

Another known purging procedure that has been implemented to prevent or alleviate internal contamination of the ink jets comprises ejecting a plurality of drops from the ink jets at a lower firing frequency than a standard firing frequency for the jets. For example, when the ink jets are refilled with ink after firing a drop, the ink forms a meniscus in the corresponding nozzle. The meniscus behaves like a naturally damped membrane that seeks equilibrium undergoing simple harmonic oscillations. When the printhead assembly is operated at high frequencies, ink jets may be fired while the ink volume in the jet is still oscillating which may result in drops being ejected that vary in weight and velocity. Operating the printhead at lower frequencies is thought to stabilize the jetting by allowing the meniscus to return to a more natural or stable state.

In any case, printing must typically be stopped while a purging and/or wiping procedure is performed. In some previously known systems, printing may be stopped in the middle of printing a page to perform a maintenance procedure. While printing is stopped to perform maintenance, a significant amount of time may be expended. For example, each jet may be fired up to 100 times or more during a purging operation. Firing the jets in such a manner may take a few minutes to complete. If the ink is purged into a waste tray, time may also be expended in the positioning of the tray and/or printhead during the purging procedure. Wiping procedures also require print stoppage while the printhead and/or wiper blade are moved relative to the other. When wiping is used in conjunction with purging, the time expended for maintenance is even greater.

Stopping printing operations to perform a purging and/or a wiping operation decreases the printing time and, consequently, the throughput of a printer. Throughput is a rated characteristic, often measured in pages printed per minute. Consumers desire faster printers, and printers with a lower throughput rating are considered less desirable. In addition to the issue of time expenditure, maintenance procedures, purging in particular, may require a relatively significant amount of ink, e.g., 7-14 grams or more of ink per purging procedure. The purged ink cannot subsequently be used for printing purposes. As the number or frequency of purging procedures increases, the amount of printing that can be performed with a given volume of ink accordingly decreases.

SUMMARY

In order to address the issues associated with the previously known ink jet maintenance methods, a maintenance method is provided for recovering ink jet failures that result from contamination of both exterior and interior ink pathways of a printhead that is more efficient in ink usage and less disruptive of printing operations than traditional maintenance procedures. The method comprises exercising the actuators from a plurality of ink jets to successively eject drops to form a plurality of images on the image receiver, or to modulate the ink meniscus at the nozzle aperture plate without the ejection of ink drops. Inter-image intervals between the ejection of drops to form one image in the plurality of images and the ejection of drops to form a successive image in the plurality of images are detected. A plurality of drops is ejected from at least a portion of the ink jets in the plurality of ink jets during at least one detected inter-image interval. The plurality of ejected drops have at least one drop ejecting characteristic selected from a group comprised of: a drop mass for the plurality of drops being greater than a standard drop mass; a drop ejecting frequency for the plurality of drops being lower than a standard drop ejecting frequency; and a substantially sequential drop ejecting pattern for the plurality of drops. The proposed method is meant to be restorative, allowing malfunctioning jets to be recovered, as well as preventative, acting as a safeguard to keep jetting instabilities and contaminants from causing malfunctions.

In another embodiment, a system for performing maintenance in an ink jet imaging device comprises an inter-image interval detector for detecting an inter-image interval between ejection of drops to form one image in a plurality of images and ejection of drops to form a successive image in the plurality of images. An inter-image interval may be detected for each pair of successively formed images in the plurality of images. The system also includes a recovery pattern controller for causing the ejection of a plurality of drops from at least a portion of ink jets in the plurality of ink jets during at least one detected inter-image interval in accordance with at least one ink jet recovery pattern. The at least one ink jet recovery pattern has at least one drop ejecting characteristic selected from a group comprised of: a drop mass for the plurality of drops being greater than a standard drop mass; a drop ejecting frequency for the plurality of drops being lower than a standard drop ejecting frequency; and a substantially sequential drop ejecting pattern for the plurality of drops.

BRIEF DESCRIPTION OF THE DRAWINGS

The foregoing aspects and other features of a fluid transport apparatus and an ink imaging device incorporating a fluid transport apparatus are explained in the following description, taken in connection with the accompanying drawings, wherein.

DETAILED DESCRIPTION

The following detailed description of various exemplary embodiments of fluid ejecting systems are directed to one specific type of fluid ejection system, an ink jet printer, for sake of clarity and familiarity. However, the principles of the method and system, as outlined and/or discussed below, can also be applied to any known or later developed fluid ejection systems, beyond the ink jet printer specifically discussed herein.

Figure 1:
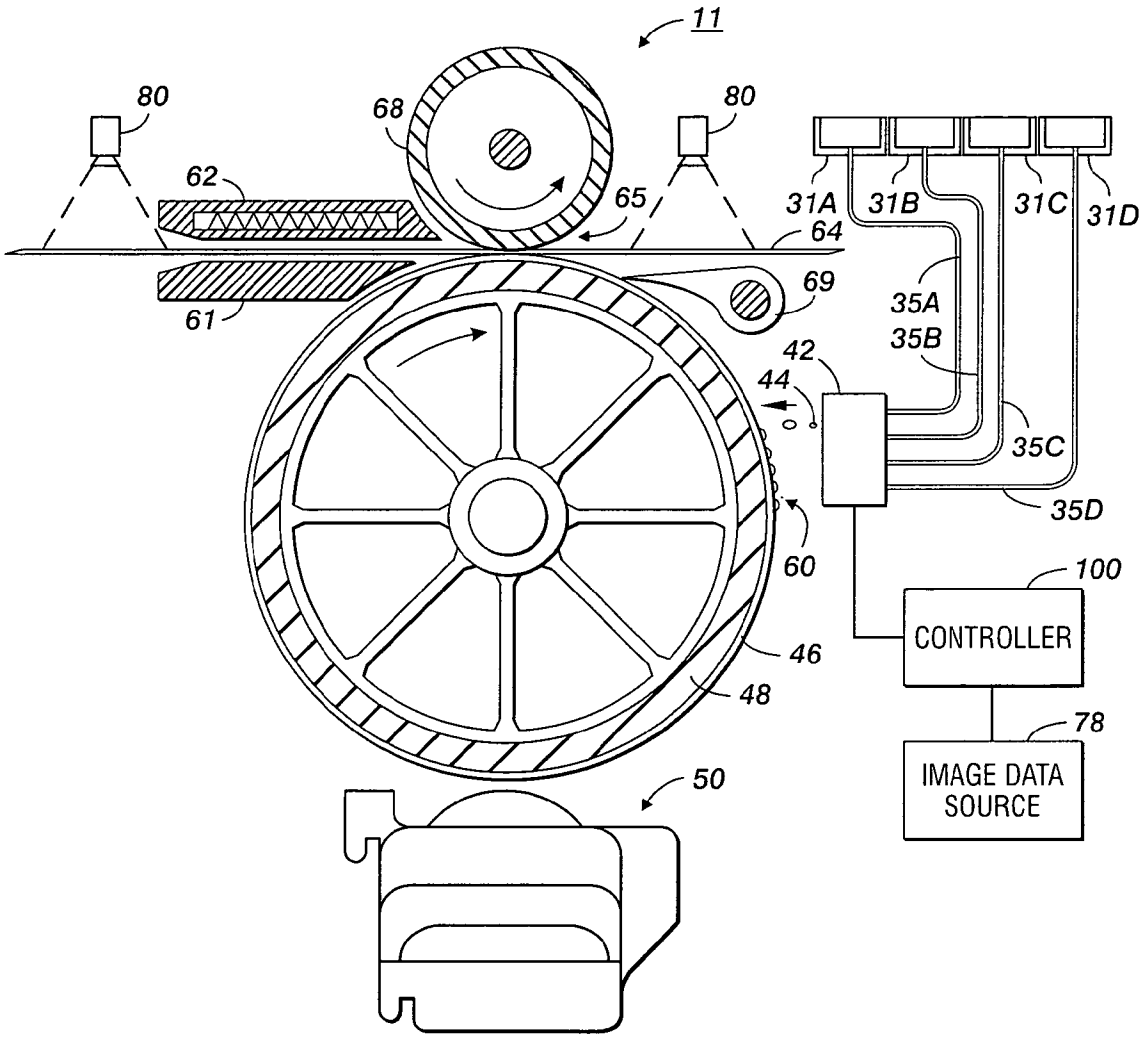
FIG. 1 is a schematic diagram of an embodiment of an ink jet imaging device.

With reference to FIG. 1, there is illustrated a schematic block diagram of an ink jet printing device 11. The printing device includes a printhead assembly 42 that is appropriately supported to emit drops 44 of ink onto an intermediate transfer surface 46 applied to a supporting surface of an imaging member 48 that is shown in the form of a drum. The imaging member may also be an endless belt, or photoreceptor. In other embodiments, the printhead assembly may eject drops of ink directly onto a print media substrate, without using an intermediate transfer surface. The ink jet printhead assembly may be incorporated into either a carriage type printer, a partial width array type printer, or a page-width type printer, and may include one or more printheads. The ink is supplied from the ink reservoirs 31A, 31B, 31C, 31D of the ink supply system through liquid ink conduits 35A, 35B, 35C, 35D that connect the ink reservoirs with the printhead 42.

The printing device 11 further includes a substrate guide 61 and a media preheater 62 that guides a recording media substrate 64, such as paper, through a nip 65 formed between opposing actuated surfaces of a roller 68 and the intermediate transfer surface 46 supported by the print drum 48. Stripper fingers or a stripper edge 69 can be movably mounted to assist in removing the print medium substrate 64 from the intermediate transfer surface 46 after an image 60 comprising deposited ink drops is transferred to the print medium substrate 64. Once an image is transferred from the intermediate transfer surface 46 onto a sheet of media 64, the drum 48 continues to rotate and any residual marking material left on the intermediate transfer surface 46 may be removed by the drum maintenance unit 50. The drum maintenance unit 50 may be configured for selective engagement with the imaging member 48 and transfer surface 46. As an alternative to the use of an intermediate transfer surface, embodiments of the printing device may be configured for direct-to-paper printing, in which the printhead assembly ejects drops directly onto the recording media without need for the intermediate imaging drum as associated sub-systems. The recording substrate may be of different sizes, textures and composition. In alternative embodiments, the printer may be a web fed printer in which a continuous web of material, such as a roll of paper, is fed from a supply roller, or the like, and taken up on a take up roller or post-processed by, for example, cutting or trimming as needed.

Figure 2:
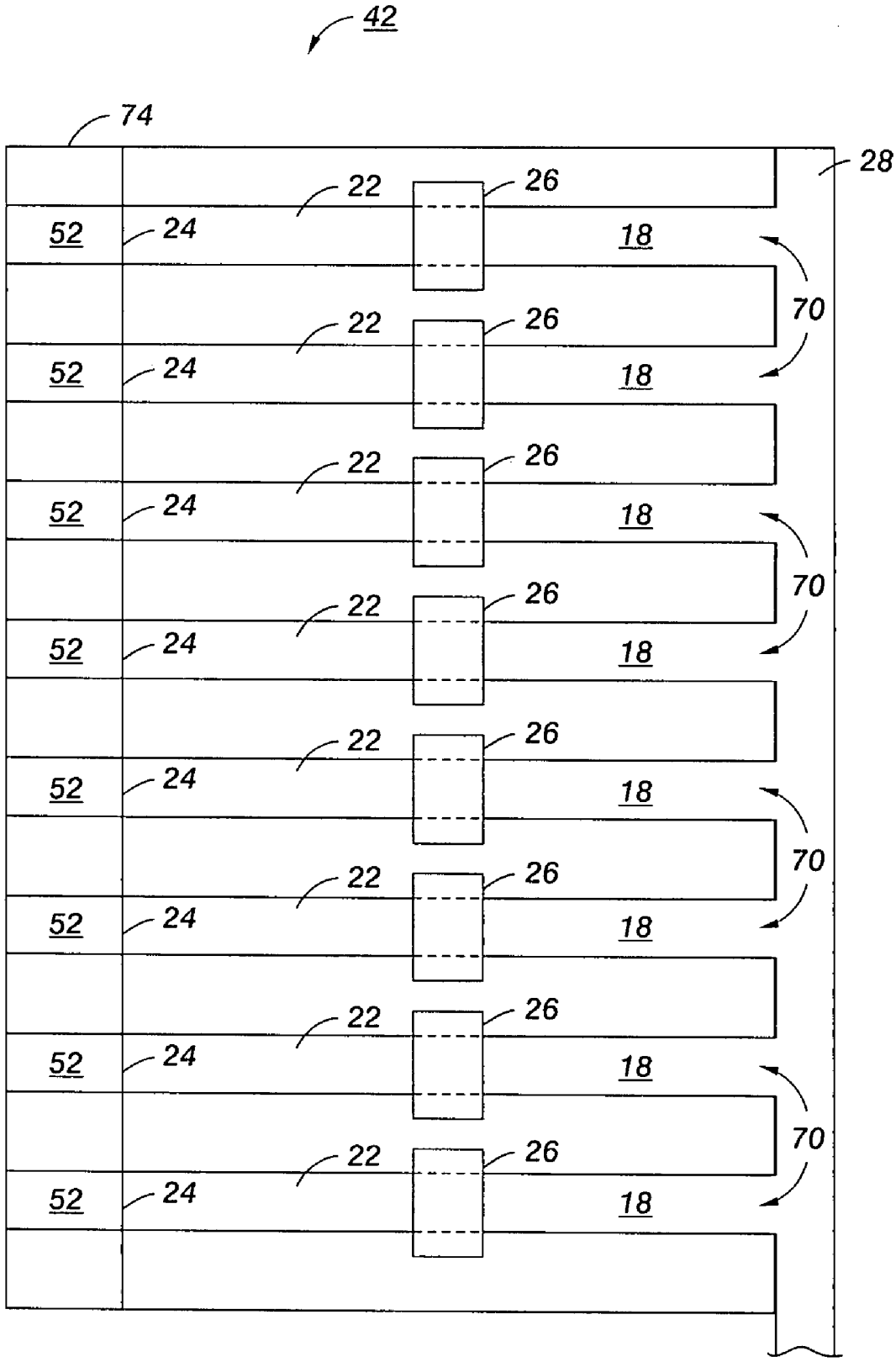
FIG. 2 is a cross-sectional view of the printhead assembly of the ink jet imaging device of FIG. 1.

With reference to FIG. 2, the printhead assembly 42 may include a plurality of ink jets for emitting drops of ink. Each ink jet includes a nozzle 52, channel 22, and actuator 26, and an inlet 70 from the supply manifold 28. The nozzles are formed in a nozzle plate 74 that is positioned to face the recording medium 64. Each nozzle 52 in the nozzle plate 74 corresponds to an orifice 24 at the end of channels 22. Drop ejecting signals are used to cause the drops of ink to be ejected at desired times from nozzles 52 that are located proximate the nozzle plate 74. An ink supply, or manifold, 28 supplies the fluid ink to the plurality of channels 22. The manifold receives the ink from an ink source such as, for example, the reservoirs 31A-D (FIG. 1). Although not depicted, the manifold 28 may employ various filtering techniques, including, but not limited to, filters and passageway designs to contain and/or trap contaminants, bubbles, debris, and/or residue within the manifold 28. A separate manifold may be provided for arrays of ink jets that are for different colors of ink or for different printheads.

In one embodiment, a piezoelectric actuator supplies the energy needed to eject drops of ink from the ink jets. In the piezoelectric fluid ejection approach, drop ejecting pulses are produced, for example, by piezoelectric elements 26 that are selectively energized by the controller 100. Alternately, other known fluid propulsion and/or ejection approaches, including, but not limited to, thermal approaches and acoustic approaches, may be used. The controller 40 selectively energizes the ink jets 18 by providing a respective drop ejecting signal to the piezoelectric elements 26 of each ink jet. A piezoelectric element 26 is provided for each of the channels 22. Each element 26 may be individually addressable to eject a drop from the nozzles in response to the signal from the controller 100.

Referring again to FIG. 1, operation and control of the various subsystems, components and functions of the device 11 are performed with the aid of a controller 100. The controller 100 may be implemented as hardware, software, firmware or any combination thereof. In one embodiment, the controller 100 comprises a self-contained, microcomputer having a central processor unit (not shown) and electronic storage (not shown). The electronic storage may store data necessary for the controller such as, for example, the image data, component control protocols, etc. The electronic storage may be a non-volatile memory such as a read only memory (ROM) or a programmable non-volatile memory such as an EEPROM or flash memory. Of course, the electronic storage may be incorporated into the ink jet printer, or may be externally located.

The controller 100 is configured to orchestrate the production of printed or rendered images in accordance with image data received from the image data source 78. The image data source 78 may be any one of a number of different sources, such as a scanner, a digital copier, a facsimile device, etc. Pixel placement control is exercised relative to the recording media 64 in accordance with the print data, thus, forming desired images per the print data as the recording media 64 is supplied by a media supply in timed registration with the image formation.

The print data received from the image data source 78 may include both control data and image data and can be compressed and/or encrypted in various formats. The image data is the data that instructs the print head to mark the pixels of an image, for example, to eject drops from specific ink jets onto specific pixel locations on an image receiver. The control data includes instructions that direct the controller to perform various tasks that are required to print an image, such as paper feed, carriage return, print head positioning, or the like. The controller is operable to generate drop generating signals for driving the actuator elements of the ink jets to expel ink drops to form an image on the image receiver in accordance with the print data.

In one embodiment, drop ejecting signals comprise waveform signals that are provided to the ink jets in a firing interval. The firing interval in which the drop ejecting signals are provided to the ink jets corresponds to the drop firing frequency. The drop firing frequency for printing during normal print operations may be any frequency depending on a number of factors, such as, for example, ink jet technology, media type, ink type, image type, etc. In one embodiment, the standard drop ejecting frequency is in the range of about 10 KHz to about 40 KHz which corresponds to a firing interval of about 100 microseconds to about 25 microseconds where the firing interval is substantially equal to the reciprocal of the drop firing frequency. The drop firing frequency may be adjusted by increasing or decreasing the firing interval in which a drop ejecting signal is provided to the ink jets. For example, increasing the firing interval decreases the drop ejecting frequency, and vice versa.

The amplitude of a drop ejecting signal determines the amount of mass, or volume, in the ink drop ejected by the nozzle. In order to adjust or modulate the drop volume of drops ejected by the ink jets, the amplitude of the drop ejecting signal may be varied. In one embodiment, in order to increase or decrease the drop mass of a drop emitted by an ink jet, the amplitude of the drop ejecting signal may be increased or decreased accordingly.

Maintenance operations are periodically required in ink jet printers for various reasons such as, for example, contamination either in the internal ink path of the printhead, on the aperture plate of the print head, or in the ink jet orifice. In order to recover and/or prevent ink jet failures due to contamination and/or jetting instabilities, the printing apparatus 11 may include a maintenance system (not shown), as is known in the art, for periodically performing a maintenance procedure on the printhead assembly. Typical maintenance procedures include purging and wiping. The maintenance system and/or the printhead assembly may be configured to be moved with respect to each other into an operable position to perform the maintenance procedure. As described above, however, typical purging and wiping procedures may be time consuming because printing must be halted, or the start of printing must be delayed while they are performed. Moreover, printer productivity may be decreased due to the expenditure of ink in the operation.

As an alternative, or in addition, to the maintenance system described, the ink jet imaging device may be configured to periodically actuate the nozzles of the printhead with ink jet recovery patterns during inter-image intervals between the printing of print job images. This actuation of the print head may be used to eject ink drops, or may be used to modulate the ink meniscus at the front of each nozzle without ejecting drops. An inter-image interval is a period of time between images. As will be explained in more detail below, the motion of the ink and ink meniscus during operation with ink jet recovery patterns has characteristics that are optimized to prevent jetting failures and to recover failed jets. By operating with the ink jet recovery patterns periodically during inter-image intervals of a print job, proper jetting may be maintained and failed jets may be recovered without having to stop print operations to perform a standard purging and/or wiping procedure. In embodiments of printers that are configured to perform standard purging and/or wiping procedures, the periodic printing of ink jet recovery patterns may reduce the frequency at which the standard maintenance procedures have to be performed in a manner that precludes image generation operations. Moreover, because the recovery patterns are jetted and not purged, the ink used may be significantly lower than the ink usage in a head maintenance cycle. If the recovery patterns are used to modulate the ink meniscus only, then no drops are ejected and there is no ink used at all.

Examples of drop ejecting characteristics that have been found to be beneficial in recovering and preventing ink jet failures include: ejecting drops from ink jets that have an increased drop mass and/or velocity relative to a standard drop mass/velocity; ejecting drops from a plurality of ink jets at a drop ejecting frequency that is lower than a standard drop ejecting frequency; and ejecting drops from a plurality of ink jets in a substantially sequential pattern. Ejecting drops from a plurality of ink jets that have an increased drop mass and/or drop velocity relative a standard drop mass may be useful in clearing contaminants from the exterior ink pathways of a printhead such as, for example, the channels, nozzles, and/or nozzle plates. The standard drop mass may be any drop mass that is typically used to print images of a print job. Drops having a mass greater than the standard drop mass may not be appropriate for printing images of print jobs. The greater size of the drops and/or the greater velocity of the drops being ejected from the ink jets may be effective in clearing, or jarring loose, contaminants from the channels, nozzles and/or nozzle plate of the ink jets that may be otherwise unaffected by drops ejected at the standard drop mass/velocity. Increasing the drop mass and/or velocity of drops ejected from an ink jet may accomplished by increasing the amplitude of the drop ejecting signal supplied to the ink jet.

Another drop ejecting characteristic that may be effective in recovering and preventing ink jet failures comprises ejecting drops from the ink jets of a printhead at low drop ejecting frequencies. For example, when the ink jets are refilled with ink after firing a drop, the ink forms a meniscus in the corresponding nozzle. The meniscus behaves like a naturally damped membrane that seeks equilibrium undergoing simple harmonic oscillations. When the printhead assembly is operated at high frequencies, ink jets may be fired while the ink volume in the jet is still oscillating which may result in drops being ejected that vary in weight and velocity. For example, if a drop is ejected when the meniscus is oscillating toward the nozzle (bulging out), the resulting drop may have a higher than normal drop mass. Similarly, if a drop is ejected when the meniscus is oscillating "into" the ink jet, the resulting drop may have a lower than normal drop mass. The proposed method of operating the head at lower frequencies is thought to stabilize the jetting by allowing the meniscus to return to a more natural or stable state.

Figure 3:
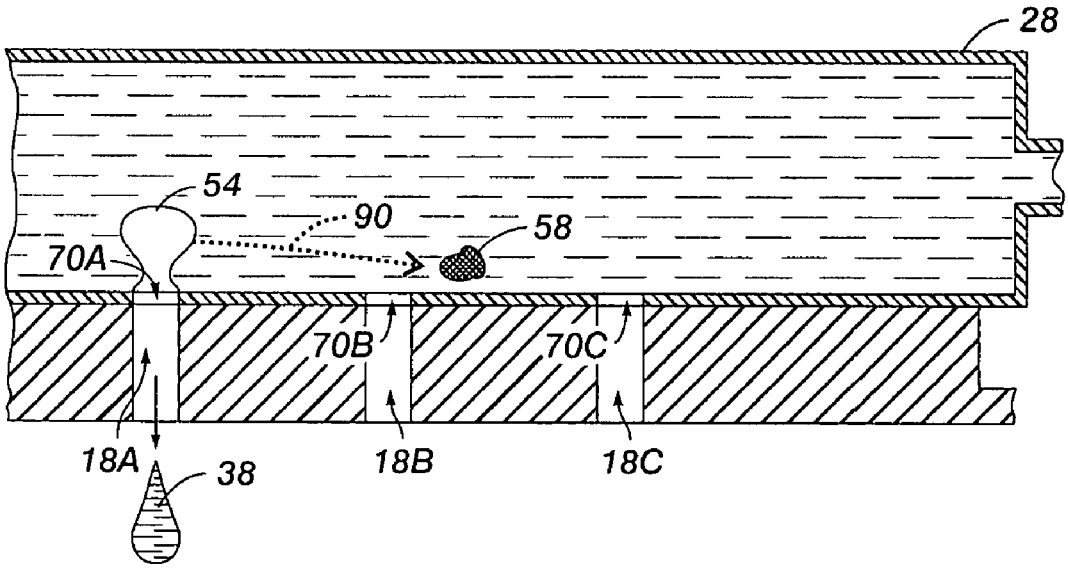
FIG. 3 is a simplified cross-sectional view of the printhead assembly showing a back pressure pulse from a first ink jet for dislodging a particle in the channel of the first ink jet into the manifold and moving the particle.

A drop ejecting characteristic that may be effective in clearing contaminants from the inlets to the ink jet channels comprises firing the ink jets in a sequential pattern in order to "move" contaminants such as bubbles, debris, residue and/or deposits into less-harmful positions into less harmful positions in the interior ink pathways of a printhead. Referring to FIG. 3, there is shown a simplified drawing of the manifold 28 and ink jets 18A-C of the printhead assembly. When debris, residue, contaminants, deposits or the like collect at or within the interior ink paths, such as, for example, the manifold 28 or the inlets 70A-C of the ink jets 18A-C, the cross-sectional flow area of the ink jet channels may become significantly reduced. This reduces the amount of fluid that can flow into the fluid channel. A partially-filled channel does not generally eject a drop of fluid correctly.

When drops 38 are ejected from ink jets, a back pressure pulse 54 is directed backwards from the ink jet 18A into manifold 28, often directing any residual fluid remaining in the ink jet 18A back into the manifold 28. The resulting back pressure pulses 54 may dislodge the particles 58 in a direction 90 towards and possibly past the adjacent channel inlet 70. The direction that any given particle 58 moves is predicated on its position on/or around the channel inlet 70A, the force of the back pressure pulse 54, and/or the angle with which any given back pressure pulse impacts a particular particle 58. Consequently, a dislodged particle 58 may land on part or portion of other channel inlets 70, or the spaces between the ink jets 18A-C.

Figure 4:
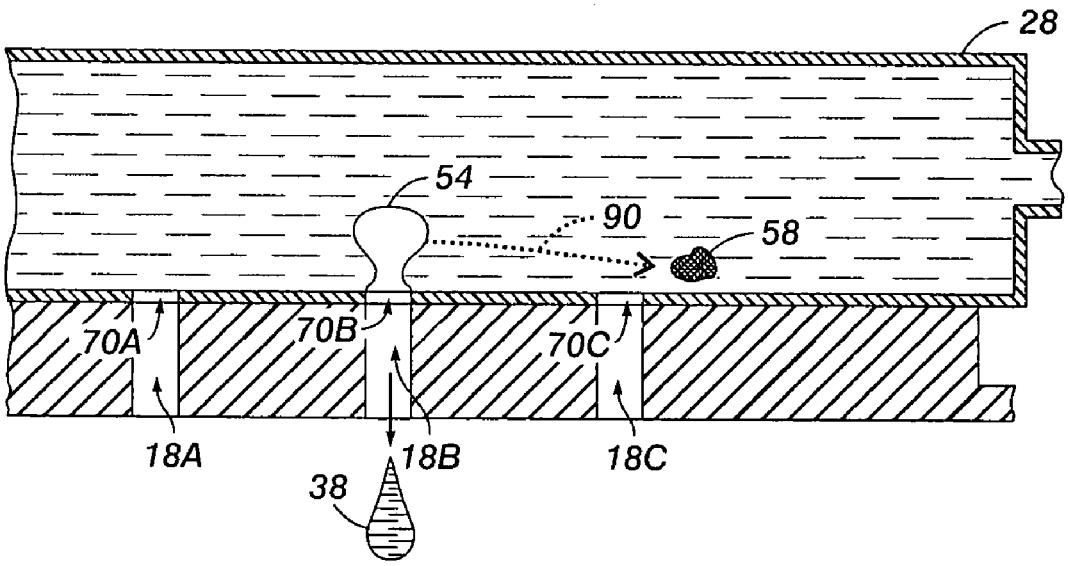
FIG. 4 is simplified cross-sectional view of the printhead assembly showing a back pressure pulse from a second ink jet adjacent to the first ink jet for further moving the particle.
Figure 5:
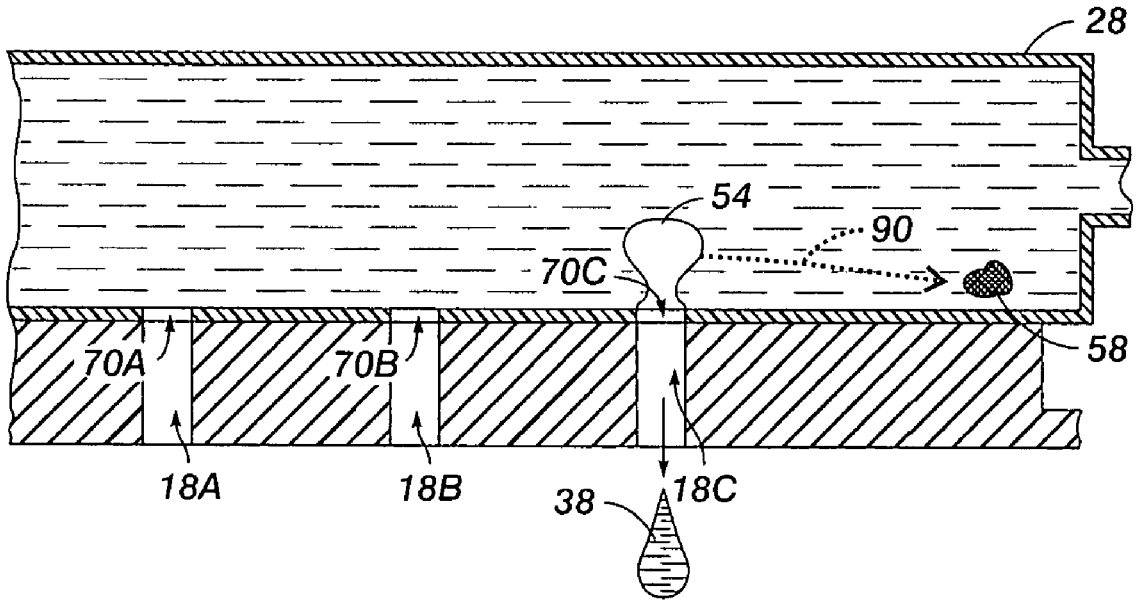
FIG. 5 is simplified cross-sectional view of the printhead assembly showing a back pressure pulse from a third ink jet adjacent to the second ink jet for further moving the particle into a less harmful position within the manifold.

The dislodged particles 58 may then be placed in a position such that, when the adjacent ink jet is fired, the particles 58 may continue to move in the direction 90 as shown in FIGS. 4 and 5 until the particles arrive at a less harmful position within the manifold 28. These less harmful positions within the manifold may include areas in which no fluid ink jets are connected, areas in which non-operative or dummy fluid ink jet channels are connected, areas in which operative but deselected fluid ink jet channels are formed, or the like.

In one embodiment, an ink jet recovery pattern comprises data, such as, for example, a bitmap, for a print controller indicating from which ink jets to eject drops and the characteristics of the drops to be ejected from the ink jets. Ink jet recovery patterns may be created and stored in the memory during system design or manufacture. Alternatively, a print controller may include software, hardware and/or firmware that are configured to generate ink jet recovery patterns "on the fly." The controller is operable to generate drop ejecting signals for driving the piezoelectric elements of the ink jets to eject drops in accordance with the ink jet recovery patterns. An ink jet recovery pattern may be printed by any number of ink jets of a printhead. In one embodiment, the ink jets of a printhead may be divided into a plurality of ink jet blocks, and an ink jet recovery pattern may be printed by one or more select ink jet blocks. The blocks may comprise linear arrays of one or more ink jets that extend partially or completely across a printhead. In certain architectures, a sensor array may be used to determine which jets are malfunctioning. In this case, the print controller could be used to send recovery patterns to only those jets known to be misfiring.

The drops ejected from select ink jets or blocks of ink jets in accordance with an ink jet recovery pattern have at least one drop ejecting characteristic that is configured to recover weak or missing ink jets and to prevent ink jet failures. In one embodiment, each ink jet recovery pattern has at least one drop ejecting characteristic selected from a group that includes: a drop mass for each of the plurality of drops that is greater than a standard drop mass, a drop ejecting frequency for the plurality of drops that is lower than a standard drop ejecting frequency, and a substantially sequential drop ejecting pattern for the plurality of drops.

Ink jet recovery patterns may be executed at any suitable time to recover and prevent ink jet failures. For example, in embodiments in which the recovery patterns are intended to only exercise the ink jet actuators to modulate the ink meniscus without ejecting drops of ink, ink jet recovery patterns may be executed at any time the jets are not being used for printing, even within an image. For recovery patterns that are configured to cause the ejection of drops, the patterns may be printed during print operations in a manner that avoids or minimizes disruption of standard printing operations. For example, in one embodiment, the recovery patterns may be printed during inter-image intervals between the printing of images of a print job. A print job may include a plurality of images wherein each image is to be printed on a separate recording medium, such a sheet of paper, or onto separate image areas of a continuous web of media, such as a roll of paper. An inter-image interval may comprise the interval between the ejection of drops to print one image of the print job and the ejection of drops to print a successive image of the print job.

To facilitate the printing of ink jet recovery patterns during inter-image intervals of a print job, the ink jet imaging device may include an inter-image interval detector for detecting the inter-image intervals between images of a print job. The manner of detection of the inter-image intervals may depend on the configuration of the ink jet imaging device. In embodiments of the ink jet imaging device in which printing takes place onto a movable series of discrete sheets of media, an inter-image interval may correspond to an interval between the movement of a trailing edge of a sheet of media out of a print zone of the ink jet imaging device and the movement of a leading edge of a successive sheet into the print zone. Similarly, in a continuous web fed device in which printing takes place onto a movable continuous web of media, an inter-image interval may correspond to an interval between the movement of a trailing edge of an image receiving area on the continuous web out of the print zone and the movement of a leading edge of a image receiving area into the print zone.

Various techniques and algorithms are known in the art for detecting or determining inter-image intervals between the printing of images of a print job. For example, in sheet fed printers, an inter-image interval detector may include one or more sheet detectors 80 (FIG. 1) operatively connected to the print controller for detecting the position of a sheet of media in the media handling system. Sheet detectors may comprise optical detectors that optically detect a sheet or mechanical detectors that mechanically detect a sheet. Other suitable sheet detectors may also be provided. For example, a controller and timing switch may be operatively connected so as to determine when a sheet has left or arrived at any location along the sheet path so as to determine when a sheet is not positioned in the print zone so that an ink jet recovery pattern may be printed.

To further reduce the time required to print an ink jet recovery pattern, recovery patterns may be printed directly onto inter-image zones of the image receiver that correspond to the inter-image intervals. An inter-image zone comprises an area on an image receiver between the drops ejected to print one image of a print job and the drops ejected to print a successive image of the print job. As an example, in a sheet fed imaging device in which printing takes place onto a movable series of discrete sheets of media, the periodic ejection of drops in accordance with the ink jet recovery patterns may take place onto an inter-image zone on the imaging member, such as a drum, for example. Movement of the media along the paper path toward the print zone between the roller 68 and intermediate transfer surface 46 does not have to be stopped while recovery patterns are printed onto the drum. Patterns printed on the drum may be subsequently cleaned from the drum at a drum maintenance station 50 as is known in the art. Alternatively, the ink jet recovery pattern may be printed on a sacrificial media sheet instead of in between discrete media sheets. The sacrificial media sheet may be a portion of a media sheet on which non-sacrificial printing takes place in other areas or it may be an entirely separate sheet for receiving the ink jet recovery pattern.

In embodiments of the imaging device that are configured to print directly onto a continuous media web rather than onto a series of individual sheets of media, ink jet recovery patterns may be printed on inter-image zones between the print areas on the web. Movement of the web may continue at the same speed during printing of the recovery patterns. The portions of the web upon which the recovery patterns are printed may be subsequently trimmed in post-processing.

A number of possible methods may be implemented for printing ink jet recovery patterns during inter-image intervals. For example, ink jet recovery patterns having different drop ejecting characteristics may be printed by the same block of ink jets during different inter-image intervals, or ink jet patterns having the same drop ejecting characteristics may be printed by different ink jet blocks during different inter-image intervals.

Ink jet recovery patterns may be periodically printed by setting an ink jet recovery interval for one or more of the recovery patterns. In one embodiment, an interval may be set such that a recovery pattern is printed after a select number of inter-image intervals have been detected. For example, a recovery interval may be set for an ink jet recovery pattern such that the ink jet recovery pattern is printed during the first inter-image interval and during every Nth inter-image interval after that one. In one embodiment, a separate interval may be set for each ink jet recovery pattern of a plurality of ink jet recovery patterns. In this embodiment, a second recovery pattern may be printed during the second inter-image interval and during every Nth inter-image interval after that one, a third recovery pattern may be printed during a third inter-image interval and during every Nth inter-image interval after that one, and so on.

Recovery intervals may be predetermined and stored in memory for access by the print controller. The intervals for printing the ink jet recovery patterns may be adjusted depending on a number of factors such as, for example, print job characteristics and/or environmental conditions. For example, the interval may be adjusted based on the type of media, the type of ink, image type, etc. For example, temperature, humidity, altitude, and debris within a work environment may affect ink jet performance and/or cause contamination within the printhead. The frequency, or interval, at which the ink jet recovery patterns are printed may be decreased or increased depending on the environmental conditions in which the ink jet imaging device is operating.

Although the embodiments above have been described in conjunction with phase change ink-jet printers, the teachings may be readily applied to other types of imaging devices such as, for example, copiers, plotters, facsimile machines, thermal ink-jet printers, etc. In addition, the illustrated embodiments may be incorporated in systems that utilize marking materials other than the phase change inks described above, such as, for example, aqueous inks, oil based inks, etc.

Those skilled in the art will recognize that numerous modifications can be made to the specific implementations of the melting chamber described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of performing ink jet maintenance in an ink jet imaging device, the method comprising:

ejecting drops from a plurality of ink jets to successively form a plurality of images on the image receiver;

detecting an inter-image interval between the ejection of drops to form one image in the plurality of images and the ejection of drops to form a successive image in the plurality of images, an inter-image interval being detected for each pair of successively formed images in the plurality of images;

ejecting a plurality of drops from at least a portion of the ink jets in the plurality of ink jets during at least one detected inter-image interval, the plurality of ejected drops having at least one drop ejecting characteristic selected from a group comprising:

a drop mass for the plurality of drops being greater than a standard drop mass;

a drop ejecting frequency for the plurality of drops being lower than a standard drop ejecting frequency; and a substantially sequential drop ejecting pattern for the plurality of drops.

2. The method of claim 1, the ejection of the plurality of drops to form a recovery pattern further comprising;

ejecting a first plurality of drops from at least a portion of the ink jets in the plurality of ink jets during at least one inter-image interval, the first plurality of drops having a drop mass greater than a standard drop mass;

ejecting a second plurality of drops from at least a portion of the ink jets in the plurality of ink jets during at least one inter-image interval, the second plurality of drops having a drop ejecting frequency lower than a standard drop ejecting frequency; and ejecting a third plurality of drops from at least a portion of the ink jets in the plurality of ink jets during at least one inter-image interval, the third plurality of drops being ejected from the at least a portion of the ink jets in the plurality of ink jets in a substantially sequential pattern.

3. The method of claim 2, the first plurality of drops, the second plurality of drops, and the third plurality of drops being ejected during different inter-image intervals.

4. The method of claim 1, the detection of the inter-image intervals further comprising:

detecting movement of a recording medium along a media pathway of the ink jet imaging device, the inter-image intervals corresponding to times when a recording medium is not in a print zone of the ink jet imaging device.

5. The method of claim 1, the ejection of the plurality of drops during the inter-image intervals further comprising:

ejecting a plurality of drops from at least a portion of the ink jets in the plurality of ink jets during at least one detected inter-image interval onto inter-image zones of the image receiver.

6. The method of claim 5, the image receiver comprising an intermediate transfer surface, the inter-image zone of the transfer surface comprising an zone between the drops ejected onto the transfer surface to print one image in the plurality of images of the print job and the drops ejected onto the transfer surface to print a successive image in the plurality of images of the print job.

7. The method of claim 5, the image receiver comprising a continuous web of media, the inter-image zone of the web comprising a zone between the drops ejected onto the web to print one image in the plurality of images of the print job and the drops ejected onto the web to print a successive image in the plurality of images of the print job.

8. The method of claim 1, further comprising:

ejecting a first plurality of drops from a first portion of ink jets of the plurality of ink jets, the first plurality of drops being ejected during a first inter-image interval; and ejecting a second plurality of drops from a second portion of ink jets in the plurality of ink jets, the second plurality of drops being ejected during a second inter-image interval;

the first plurality of drops and the second plurality of drops each having at least one drop ejecting characteristic selected from:

a drop mass greater than a standard drop mass;

a drop ejecting frequency lower than a standard drop ejecting frequency; and a substantially sequential drop ejecting pattern;

the at least one drop ejecting characteristic of the second plurality of drops being the same as the at least one drop ejecting characteristic of the first plurality of drops.

9. The method of claim 1, further comprising:

ejecting a first plurality of drops from a first portion of ink jets in the plurality of ink jets, the first plurality of drops being ejected during a first inter-image interval;

ejecting a second plurality of drops from the first portion of ink jets in the plurality of ink jets, the second plurality of drops being ejected during a second inter-image interval, the first plurality of drops and the second plurality of drops each having at least one drop ejecting characteristic selected from:

a drop mass greater than a standard drop mass;

a drop ejecting frequency lower than a standard drop ejecting frequency; and a substantially sequential drop ejecting pattern; and the at least one drop ejecting characteristic of the first plurality of drops being different than the at least one drop ejecting characteristic of the second plurality of drops.

10. The method of claim 1, further comprising:

setting an ink jet recovery interval for the ejection of the plurality of drops during inter-image intervals having the at least one drop ejecting characteristic such that the ejection of the plurality of drops having the at least one drop ejecting characteristic occurs periodically during inter-image intervals corresponding to the ink jet recovery interval.

11. A system for performing ink jet maintenance in an ink jet imaging device, the system comprising:

an inter-image interval detector for detecting an inter-image interval between ejection of drops to form one image in a plurality of images and ejection of drops to form a successive image in the plurality of images, an inter-image interval being detected for each pair of successively formed images in the plurality of images; and a recovery pattern controller for causing the ejection of a plurality of drops from at least a portion of ink jets in the plurality of ink jets during at least one detected inter-image interval in accordance with at least one ink jet recovery pattern, the at least one ink jet recovery pattern having at least one drop ejecting characteristic selected from:

a drop mass for the plurality of drops being greater than a standard drop mass;

a drop ejecting frequency for the plurality of drops being lower than a standard drop ejecting frequency; and a substantially sequential drop ejecting pattern for the plurality of drops.

12. The system of claim 11, the at least one ink jet recovery pattern further comprising:

a first ink jet recovery pattern having a drop ejecting characteristic such that drops ejected in accordance with the first recovery pattern have a drop mass greater than a standard drop mass;

a second ink jet recovery pattern having a drop ejecting characteristic such that drops ejected in accordance with the second recovery pattern are ejected at a drop ejecting frequency lower than a standard drop ejecting frequency; and a third ink jet recovery pattern having a drop ejecting characteristic such that drops ejected in accordance with the thirds recovery pattern are ejected in a substantially sequential pattern from the at least a portion of ink jets in the plurality of ink jets.

13. The system of claim 12, the recovery pattern controller being configured to print each recovery pattern in the first, second and third recovery patterns during different inter-image intervals.

14. The system of claim 12, further comprising:

a recovery pattern interval controller for setting a recovery pattern interval for at least one of the first, second and third recovery patterns, the recovery pattern interval corresponding to a number of inter-image intervals between the printing of the at least one of the first, second and third recovery patterns; and the recovery pattern controller being configured to print the at least one of the first, second and third recovery patterns in accordance with the recovery pattern interval.

15. The system of claim 14, the recovery pattern interval controller being configured to set an ink jet recovery interval for each of the first, second and third ink jet recovery patterns.

16. The system of claim 11, the inter-image interval detector comprising a sheet detector for detecting movement of a recording medium along a media pathway of the ink jet imaging device, the inter-image intervals corresponding to times when a recording medium is not in a print zone of the ink jet imaging device.

17. The system of claim 11, the recovery pattern controller being configure to print the ink jet recovery patterns during at least one detected inter-image interval onto inter-image zones of an image receiver of the ink jet imaging device.

18. The system of claim 11, the image receiver comprising an intermediate transfer surface, the inter-image zone of the transfer surface comprising an zone between the drops ejected onto the transfer surface to print one image in the plurality of images of the print job and the drops ejected onto the transfer surface to print a successive image in the plurality of images of the print job.

19. The system of claim 11, the image receiver comprising a continuous web of media, the inter-image zone of the web comprising a zone between the drops ejected onto the web to print one image in the plurality of images of the print job and the drops ejected onto the web to print a successive image in the plurality of images of the print job.

* * * * *